United States Patent [19]

Iwata

[11] 4,436,440

[45] Mar. 13, 1984

[54] SHIFTABLE DAISY WHEEL PRINTER

[75] Inventor: Nobuo Iwata, Kanagawa, Japan

[73] Assignee: Ricoh Company, Ltd., Japan

[21] Appl. No.: 315,443

[22] Filed: Oct. 27, 1981

[30] Foreign Application Priority Data

Nov. 10, 1980 [JP] Japan ..... 55-157833

[51] Int. Cl.[3] ..... B41J 1/24

[52] U.S. Cl. ..... 400/144.2; 403/57; 464/120

[58] Field of Search ..... 400/144.2; 403/57, 58; 464/136, 112, 122, 102–105, 115, 120, 132

[56] References Cited

U.S. PATENT DOCUMENTS

| | | | |
|---|---|---|---|
| 1,411,468 | 4/1922 | Wood | 464/102 |
| 3,595,591 | 7/1971 | Koch et al. | 464/103 |
| 3,606,768 | 9/1971 | Wildhaber | 464/103 |
| 4,165,190 | 8/1979 | Suzuki et al. | 400/144.2 |

FOREIGN PATENT DOCUMENTS

| | | | |
|---|---|---|---|
| 692868 | 6/1953 | United Kingdom | 464/112 |

*Primary Examiner*—Edgar S. Burr
*Assistant Examiner*—David A. Wiecking
*Attorney, Agent, or Firm*—Guy W. Shoup; Gerard F. Dunne

[57] ABSTRACT

A printer includes a type wheel carrying a multiplicity of fingers each carrying types disposed in a plurality of tiers, and centrally formed with a rotary shaft. The type wheel is disposed perpendicular to the axis of a platen. The printer performs a printing operation by imparting to the type wheel a motion which selects one of the plurality of tiers and a rotary motion for selecting one of the multiplicity of fingers. A rotating drive from a drive shaft is transmitted to the rotary shaft of the type wheel through a joint comprising a pair of closely disposed or coplanar pins which are orthogonal to each other and a ring-shaped or forked coupling member having openings or grooves in which the respective pins are slidably fitted.

17 Claims, 8 Drawing Figures

FIG. 1B
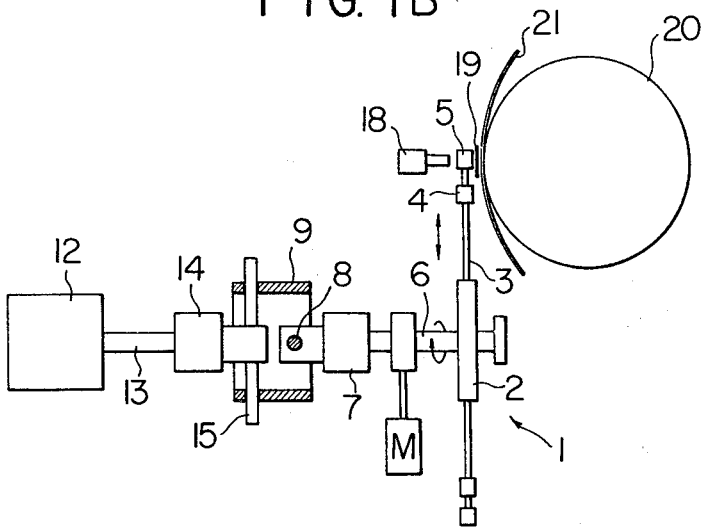
FIG. 2
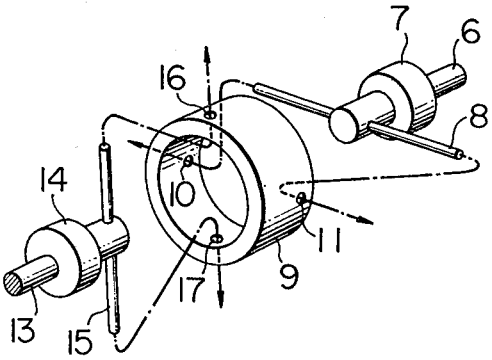
FIG. 3
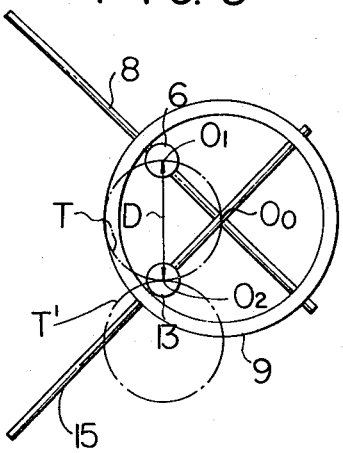
FIG. 7

SHIFTABLE DAISY WHEEL PRINTER

BACKGROUND OF THE INVENTION

This invention relates to a printer, in particular, to a printer including a type wheel carrying a multiplicity of fingers carrying types in a plurality of tiers. The type wheel is centrally formed with a rotary shaft and disposed perpendicular to the axis of a platen, wherein a printing operation may be performed by imparting to the type wheel a translational motion to select one of the plurality of tiers or type and a rotary motion for selecting one of the multiplicity of fingers.

In the printer of the type described above, a rotating drive from a drive shaft is normally transmitted to the rotary shaft of the type wheel through an axially translatable universal joint. To select a type located in one of the plurality of tiers, the type wheel must be moved in a direction or a plane perpendicular to the axis of the platen, normally in the vertical direction. A joint which is incapable of axial translation cannot be used since then the type wheel will rock about the joint and cannot be moved in a direction or a plane perpendicular to the axis of the platen. To select one of the multiplicity of fingers by a rotary motion, a controlled angle of rotation of the drive shaft connected to a motor must be precisely transmitted to the rotary shaft of the type wheel. In addition, to provide a compact arrangement, the joint itself must be reduced in size, in particular, its coupling distance must be reduced. Thus, it will be seen that there are a number of requirements imposed upon a joint which is used to provide a connection between the rotary shaft of a type wheel used in a printer and an associated drive shaft.

SUMMARY OF THE INVENTION

The above requirements are fully satisfied by the use of a joint according to the invention. The joint according to the invention comprises a pair of closely disposed or coplanar pins which are orthogonal to each other, and a ring-shaped or forked coupling member having openings or grooves in which the respective pins are slidably fitted. One of the coupling members is connected to the drive shaft of a motor while the other is connected to the rotary shaft of the type wheel. Since each pin is slidably fitted into an opening of the associated coupling member, a translational movement of the rotary shaft of the type with respect to the drive shaft of the motor is permitted while allowing the transmission of a rotating drive therebetween, thus enabling a motion thereof in a direction perpendicular to the axis of the platen in order to select a particular type.

Therefore, it is an object of the invention to provide a printer having a compact joint which assures a reliable operation.

It is another object of the invention to provide a printer having a joint which has an increased durability.

Above and other objects, features and advantages of the invention will become apparent from the following description with reference to the attached drawings.

BRIEF DESCRIPTION OF THE DRAWINGS

FIGS. 1A and 1B are schematic views of a printer according to one embodiment of the invention.

FIG. 2 is an exploded perspective view of a joint used in the printer of FIGS. 1A and 1B.

FIG. 3 is a view illustrating the locus of a coupling ring of the joint used in the printer of FIG. 1.

FIG. 7 is a cross section showing an alternative shape of the pins.

DESCRIPTION OF EMBODIMENTS

Figure 1A:
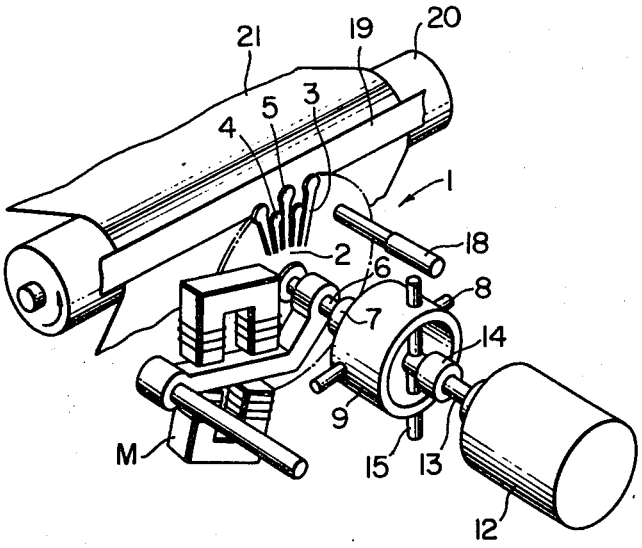

Referring to FIG. 1, there is schematically shown a printer according to one embodiment of the invention, which is of the same type as that disclosed in U.S. Pat. No. 4,106,611 issued to T. Suzuki and N. Iwata on Aug. 15, 1978 and the assignee hereof. The printer includes a type wheel 1 having a central disc 2 from which a multiplicity of fingers 3 extend radially at an equal angular interval. Each of the fingers 3 carries types 4, 5 in a pair of tiers. A rotary shaft 6 is secured to the center of the type wheel 1, and its one end fixedly carries a cap 7. A pin 8 is fixedly mounted on the free end of the cap 7 and extends in a direction perpendicular to the rotary shaft 6, and is slidably fitted into a pair of openings 10, 11 (FIG. 2) which are formed in a surrounding ring-shaped coupling member 9. On the other hand, a similar cap 14 is fixedly mounted on the free end of a drive shaft 13 of a motor 12, and a pin 15 is fixedly mounted on the free end of the cap so as to extend in a direction perpendicular to the drive shaft 13, and is slidably fitted into a pair of openings 16, 17 formed in the coupling member 9 so as to be orthogonal to the first mentioned pin 8. The drive shaft 13 of the motor is disposed so that its axis is parallel to the axis of the rotary shaft 6 of the type wheel, and the rotary shaft 6 is adapted to be moved, by displacement means such as an electromagnet M, so that the type 4 moves upwardly to the position of the type 5 shown. An impact hammer 18 is disposed to alignment with the illustrated position of the type 5 and on the outside thereof, and may strike either type 5 or type 4 after the latter has been displaced upwardly, against a record sheet 21 disposed around a platen 20 with an ink ribbon 19 interposed therebetween, thus achieving a selective printing operation. It is to be noted that the type wheel 1 is disposed in a plane which is parallel to the axis of the platen 20.

A position signal applied to the motor 12 causes it to rotate through a given angle in order to select one of the fingers 3 which carries a type to be used in a printing operation. If required, the displacement means M is simultaneously actuated and causes the rotary shaft to shift upwardly, allowing one of the types 4 in the lower tier to be selected. It is a distinction of the joint used in the invention from a conventional universal joint that the pins 8 and 15 are slidable in the openings formed in the coupling member 9 so that a translational or a motion of the rotary shaft 6 as it remains parallel with respect to the drive shaft 13 is possible while simultaneously allowing the transmission of rotation therebetween. FIG. 3 shows the locus of the coupling member 9 during such process. Specifically, the coupling member 9 is shown as having a center $O_0$ depicting a locus T in the form of the circumference of a circle having a diameter D which is defined by a line joining the center $O_1$ of the rotary shaft 6 of the type wheel when it has undergone a maximum displacement and the center $O_2$ of the drive shaft 13 of the motor. The rotary shaft 6 may be moved vertically upward or downward from the home position if the print position is located intermediate the location of the types 4 and 5 shown. The remaining locus T′ of the coupling member 9 would then be in an "8" shape which is centered about the center $O_2$ of the drive shaft of the motor.

Preferably, the pins 8, 15 are formed of hardened steel or stainless steel while the coupling member 9 is formed of an anti-abrasion plastic material, for example, "RULON" manufactured by TOYO Bearing Company or polyimide resins. To provide a compact joint, the pins 8 and 15 should be located close to each other. In this embodiment, the areal contact between the pins and the openings in which they are fitted reduces the abrasion, permitting a plastic material of a light weight to be used for the coupling member. By increasing the outer diameter of the coupling member as required, a difference in the outer diameter between the coupling member and the type wheel can be reduced to thereby reduce any load which is applied to the joint, thus allowing the abrasion which occurs in the joint to be reduced to minimize any offset in the printing position. In the present embodiment, the pins simply slide, so that rods having a square cross section as shown in FIG. 7 may be used as such pins, and may be received in square openings.

Figure 4:
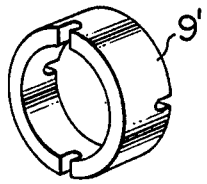
FIG. 4 is a perspective view of another form of coupling member used in the joint of the invention.
Figure 5:
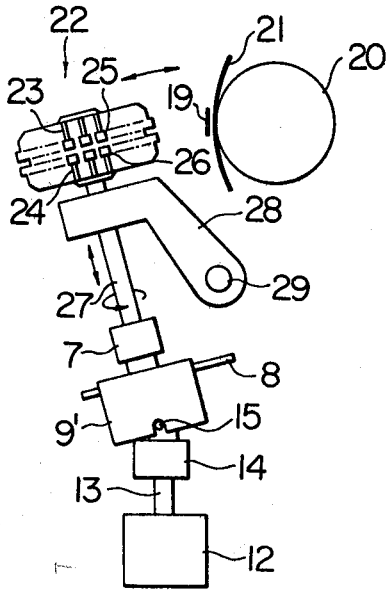
FIG. 5 is a schematic view of a printer according to another embodiment of the invention.

As shown in FIG. 4, the openings formed in the coupling member 9 to receive the pins may be formed as grooves. Alternatively, the openings to receive one of the pins may be formed as grooves. When such a coupling member 9′ is used, an axial movement of the rotary shaft of the type wheel is permitted, and hence the arrangement can be used in a printer of the type as shown in FIG. 5. Specifically, referring to FIG. 5, the printer includes a type wheel 22 carrying a multiplicity of fingers 23, 24 which are circumferentially spaced from each other and extending upwardly and downwardly from the lower and the upper end of the peripheral surface. Each of the fingers fixedly carries a type 25 or 26 on its free end. A rotary shaft 27 is secured to the center of the type wheel 22 so as to extend in a direction parallel to the fingers, and is utilized to rotate the type wheel 22. The rotary shaft 27 is slidably and rotatably carried by a hammer link 28, which is pivotally mounted on a pin 29 for impacting a particular type on the type wheel 22 against a platen 20 for performing a printing operation. The rotary shaft 27 of the type wheel can be shifted axially by displacement means, not shown, in order to permit either type 25 in the upper tier or case or type 26 in the lower tier or case to be selected. Such shift or displacement of the rotary shaft 27 is permitted by the provision of grooves, as indicated in FIG. 4, in the coupling member 9′ for engagement with the pin 15. The coupling member 9′ having such grooves for fitting engagement with the pin not only permits an axial movement of the rotary shaft 27 which is connected thereto, but advantageously facilitates the assembly and manufacture of the joint, as compared with the coupling member 9 shown in FIG. 1. In this embodiment, when in the retracted position shown, the output shaft of the motor is not parallel to the axis of the type wheel, so that the uniform rotation of the motor is not properly transmitted to the rotary shaft of the type wheel, and the uniform rotation is precisely transmitted in the printing position where the shaft of the type wheel extends parallel to the motor shaft.

Figure 6:
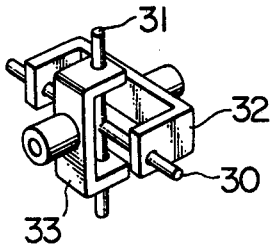
FIG. 6 is a perspective view of another joint used in the present invention.

As an alternative arrangement, FIG. 6 shows another joint according to the invention including a pair of pins 30, 31 which cross each other in a crisscross form and are fixed to one another at their junction, and a pair of forked coupling members 32, 33 which are formed with openings or grooves as in FIG. 4 which slidably and rotatably receive these pins. The rotary shaft of the type wheel is secured to one of the coupling members at right angles thereto while the drive shaft of a motor is connected to the other coupling member at the right angles thereto. While it may appear that such joint is similar to Hooke's universal joint, there is a clear distinction in that the crossing pins are slidable relative to the forked members. In this embodiment, the coupling distance or the separation between the input and output members of the joint is further reduced, allowing a compact joint to be realized. By forming the crossing pins and the forked coupling members of materials as mentioned above, there is provided a light weight and a durable joint.

Having disclosed several embodiments of the invention, it will be obvious to one skilled in the art that various changes and modifications can be made therein without departing from the spirit and scope of the invention as defined by the appended claims.

What is claimed is:

1. A printer including a type wheel carrying a multiplicity of fingers carrying type in a plurality of tiers and centrally provided with a rotary shaft, means for achieving a printing operation by imparting to the type wheel a motion to select one of the plurality of tiers and a rotary motion to select one of the muliplicity of fingers; characterized in that said means includes a rotatable drive shaft for transmitting torque to said rotary shaft of the type wheel through a joint comprising a pair of pins substantially orthogonal to each other and a coupling member having portions slidably receiving each of said pins, said portions being spaced radially outwards from each of said shafts.

2. A printer according to claim 1 in which the joint comprises a first pin secured to the end of the rotary shaft of the type wheel at right angles thereto, a second pin secured to the end of a drive shaft at right angles thereto, and a ring-shaped coupling member having pairs of openings adapted to slidably receive the pins, the pairs being located close to each other in the axial direction of said coupling member and are oriented substantially orthogonal to each other, the end of the rotary shaft of the type wheel and the end of the drive shaft being located within the ring-shaped coupling member.

3. A printer accoring to claim 2 in which the center of the ring-shaped coupling member depicts a circular locus as the rotary shaft of the type wheel moves between its home position and its shifted position.

4. A printer according to claim 2 in which the center of the ring-shaped coupling member depicts an 8-shaped locus as the rotary shaft of the type wheel moves between its home position and its shifted position.

5. A printer according to claim 2 in which the ring-shaped coupling member is formed or a resin having an abrasion resistance while the pins are formed of steel.

6. A printer according to claim 2 in which the pins are in the form of rods having a round cross section and are received in round openings formed in the ring-shaped coupling member.

7. A printer according to claim 6 in which at least one pair of openings formed in the ring-shaped coupling member comprises grooves for receiving one of the pins.

8. A printer according to claim 2 in which the pins are in the form of rods having a square cross section and are received in square openings formed in the ring-shaped coupling member.

9. A printer according to claim 8 in which at least one pair of openings formed in the ring-shaped coupling member comprises grooves for receiving one of the pins.

10. A printer according to claim 1 in which the joint comprises a first forked coupling member secured to the end of the rotary shaft of the type wheel at right angles thereto, a second forked coupling member secured to the end of a drive shaft at right angles thereto, and a pair of pins slidably fitted into openings formed in the forked limbs of the respective coupling members to couple the coupling members together, the pins crossing each other to a crisscross form.

11. A printer according to claim 10 in which the pins are in the form of rods having a round cross section and are received in round openings formed in the forked coupling members.

12. A printer according to claim 11 in which at least one pair of openings formed in the forked coupling members comprising grooves for receiving one of the pins.

13. A printer according to claim 10 in which the pins are in the form of rods having a square cross section and are received in square openings formed in the forked coupling member.

14. A printer according to claim 13 in which at least one pair of openings formed in the forked coupling member which is engaged by one of the pins are formed as grooves.

15. A printer according to claim 9 in which the pins are formed from steel while the forked coupling members are formed of a resin having abrasion resistance.

16. A printer according to claim 1, wherein said rotary shaft is movable both upwardly and downwardly relative in said drive shaft.

17. A printer according to claim 1, said type wheel having two of said tiers of type and normally being held in a neutral position with a first tier normally being held above a printing position, the second tier normally being held below said printing position, and said rotary shaft normally being substantially coaxial to said drive shaft, said means including translation means for moving said rotary shaft in a first direction while being maintained essentially parallel to said drive shaft to select type from one of said tiers and moving said rotay shaft in the opposite direction while being maintained essentially parallel to said drive shaft to select type from the other tier.

* * * * *